US005806163A

United States Patent [19]

Shimai et al.

[11] Patent Number: 5,806,163

[45] Date of Patent: Sep. 15, 1998

[54] METHOD AND APPARATUS FOR FORMING ELEMENT-FREE SPACE PORTION IN SLIDE FASTENER CHAIN

[75] Inventors: Hideo Shimai; Osamu Fujii; Toyoo Morita; Kazuki Kuse, all of Toyama-ken, Japan

[73] Assignee: YKK Corporation, Tokyo, Japan

[21] Appl. No.: 979,333

[22] Filed: Nov. 24, 1997

Related U.S. Application Data

[63] Continuation of Ser. No. 657,051, May 29, 1996, abandoned.

[30] Foreign Application Priority Data

May 31, 1995 [JP] Japan ..... 7-133869

[51] Int. Cl.[6] ..... A41H 37/06; B21D 53/50

[52] U.S. Cl. ..... 29/408; 29/770; 83/921

[58] Field of Search ..... 29/766, 770, 408, 29/33.2; 83/921

[56] References Cited

U.S. PATENT DOCUMENTS

| | | | |
|---|---|---|---|
| 4,490,899 | 1/1985 | Schelling | 29/770 |
| 4,627,318 | 12/1986 | Hochlehnert et al. | 29/770 |
| 4,638,542 | 1/1987 | Akiyama et al. | 29/770 |
| 4,738,016 | 4/1988 | Samberg | 29/770 |
| 5,103,540 | 4/1992 | Hirasawa | 29/770 |
| 5,177,855 | 1/1993 | Shimai | 29/770 |
| 5,212,863 | 5/1993 | Matsumoto | 29/770 |
| 5,335,404 | 8/1994 | Ozaki et al. | 29/770 |

FOREIGN PATENT DOCUMENTS

| | | |
|---|---|---|
| 0 488 816 | 6/1992 | European Pat. Off. . |
| 6-49008 | 6/1994 | Japan . |

*Primary Examiner*—P. W. Echols
*Attorney, Agent, or Firm*—Hill & Simpson

[57] ABSTRACT

In forming an element-free space portion in a continuous fastener chain, legs of a number of metallic fastener elements, which legs exist on one side of the fastener chain are cut by a pair of cutting blades, and then coupling heads of the fastener elements and the legs extending from the coupling heads and existing on the other side of the fastener chain are removed from cores of fastener tapes while being clamped by a punch and a die. Therefore, it is possible to remove the fastener element portions from the fastener tapes without damaging the cores and not to require so high precision in positioning the fastener elements at a cutting station, thus the structure of a slide fastener chain manufacturing machine can be simple and hence the rate of production is improved.

4 Claims, 4 Drawing Sheets

METHOD AND APPARATUS FOR FORMING ELEMENT-FREE SPACE PORTION IN SLIDE FASTENER CHAIN

This is a continuation of application Ser. No. 08/657,051, filed May 29, 1996, now abandoned.

BACKGROUND OF THE INVENTION

1. Field of the Invention

This invention relates to a method of and an apparatus for forming an element-free space portion in a continuous slide fastener chain by removing a predetermined length of coupled rows of metallic fastener elements from a pair of opposed fastener tapes, each fastener element having a coupling head and a pair of legs mounted astride of the individual fastener tape.

2. Description of the Related Art

In manufacturing slide fasteners successively from a continuous length of slide fastener chain, the slide fastener chain is intermittently fed to a space forming station by a slide fastener length at every time, and in the space forming station, a predetermined length of continuous coupled fastener elements are removed from the slide fastener chain to form an element-free space portion each time the feeding of the slide fastener chain is interrupted. The cut fastener elements left over at ends of the element-free space section would constitute various hindrances in attaching slide fastener components, such as top stops, a slider and a bottom stop, in subsequent processes.

Attempts have been made to cope with the above-mentioned problem. Japanese Patent Publication No. Hei 6-49008, for example, discloses an element-free space forming method in which a space-forming section of a continuous slide fastener chain in a space forming station is positioned with high precision and no cut fastener elements are left over at ends of the space-forming section, irrespective of flexibleness and tension change of the slide fastener chain during the process. According to this prior method, when the continuous slide fastener chain is stopped while it is intermittently supplied to an element-free space forming apparatus, a first positioning pin is brought into engagement with a fastener element in a non-space-forming section contiguous to the one at the front end of the space-forming section, and then more than half of the fastener elements of the space-forming section are removed. After the first positioning pin is released from engagement with the slide fastener chain, a second positioning pin is brought into engagement with a fastener element in a non-space-forming section contiguous to the one at the rear end of the space-forming section, and then the fastener elements left over in the space-forming section are removed. Thus an element-free space portion devoid of partially broken fastener elements is formed. Then the second positioning pin is released from engagement with the slide fastener chain to finalize a single cycle of process.

However, according to Japanese Patent Publication No. Hei 6-49008, the fastener elements of a space-forming section are removed by punching out the connecting portion between the coupling head and a pair of legs branching from the coupling head to separate the coupling head and the legs in a single action. Since the fastener elements are punched out at the utmost possible limit to the cores, the punch would tend to contact the cores of the fastener tapes. Therefore, if the fastener elements are not mounted on the fastener tapes uniformly, the punch strikes the core to break them.

In an effort to eliminate the foregoing problem in removing the fastener elements, Japanese Patent Laid-Open Publication No. Hei 4-197304, for example, discloses an improved method which comprises the steps of clamping coupling heads of synthetic resin fastener elements from upper and lower sides by a punch and a die, cutting connecting portions between the coupling heads and the upper legs by a cutter, separating the upper legs from the coupling heads and the lower legs, moving the cutter transversely of the fastener tapes, removing the upper legs from the fastener tapes, and removing the coupling heads and the lower legs from the fastener tapes by lowering the punch and die perpendicularly of the plane of the slide fastener chain while the coupling heads are clamped between the punch and die.

In Japanese Patent Laid-Open Publication No. Hei 4-197304, the fastener elements are made of synthetic resin. And since the fastener elements are mounted on the fastener tapes by injection molding, part of the upper and lower legs of the fastener elements penetrate into the fastener tapes during molding, so that the upper legs would be left over on the fastener tapes and would therefore be difficult to be removed merely by being cut by the cutter. Consequently, after it is moved vertically to cut the upper legs, the cutter is moved sideways to scratch the upper legs off the fastener tapes.

With the fastener-element removing apparatus of Japanese Patent Laid-Open Publication No. Hei 40-197304, the cutter requires two actions to remove the upper legs, thus making the mechanism of the apparatus complex so that the cutting process cannot be simplified.

SUMMARY OF THE INVENTION

It is therefore an object of this invention to provide a method of and an apparatus for forming an element-free space portion in a continuous slide fastener chain having a pair of metallic fastener element rows by removing the fastener elements of a space-forming section effectively, without damaging cores of the fastener chain, using a simplified mechanism.

The present inventors have studied if there is any possibility of developing a method of and an apparatus for removing metallic fastener elements, based on the inventive concept of method and apparatus for removing synthetic resin fastener elements disclosed in Japanese Patent Laid-Open Publication No. Hei 4-197304, and found that simplification of the method and apparatus could be accomplished easily, based on an attaching mechanism of metallic fastener elements to the fastener tapes. The metallic fastener elements are mounted on the fastener tapes by clenching their upper and lower legs about the confronting tape edges. Therefore, part of the legs only bite into the fastener tapes and do not penetrate into the fastener tapes. This means that when one of upper and lower legs is cut, it is easily separated from other fastener element portions. The present inventors have also found that a leg cut from a metallic fastener according to the method and apparatus of the present invention hops, i.e. scatters, away from the fastener tape at the moment the leg is severed from the fastener. In this manner, the cut legs are removed without transverse movement of the cutters and without manually removing the cut legs from the fastener tape.

According to a first aspect of this invention, the above object is accomplished by a method of forming an element-free space portion in a continuous slide fastener chain having a pair of coupled rows of metallic fastener elements mounted on and along confronting inner edges of a pair of fastener tapes, the method comprising the steps of: clamping a number of fastener elements, which exist in a space-forming section of the fastener element rows, at their coupling heads by a punch and a die; cutting one of upper and lower legs of each of the clamped fastener elements at a position toward the coupling head by a cutting blade and, at the same time, scattering the cut legs; and with the coupling heads and the other legs, which are left over on the fastener tapes, being clamped by the punch and the die, removing the leftover fastener element portions from the fastener tapes by pushing the leftover fastener element portions outwardly in a direction perpendicular to the plane of the fastener tapes.

According to a second aspect of the invention, the above method is carried out by an apparatus for forming an element-free space portion in a continuous slide fastener chain having a pair of coupled rows of metallic discrete fastener elements mounted on and along confronting inner edges of fastener tapes, the apparatus comprising: a base having a long and narrow central gap for guiding the continuous slide fastener chain in a longitudinal path; a punch and a die situated above and under the central gap for vertical movement to clamp a number of fastener elements, which exist in a space-forming section in the continuous fastener chain, at their coupling heads and to push the clamped fastener elements out of the space-forming section upwardly or downwardly; and a pair of horizontally spaced cutting blades cooperative with the punch for cutting upper or lower legs of the fastener elements, which are clamped by the punch and the die, at positions toward their coupling heads. Preferably, the two cutting blades have the same length and are staggered by one pitch of the fastener element in a direction of travel of the fastener chain.

In this invention, after the legs of the fastener elements on one side of the slide fastener chain at a space-forming section are cut and scattered, the coupling heads and the legs on the other side of the slide fastener chain at the same space-forming section are pulled off the cores of the fastener tapes while they are clamped by the punch and die. It is accordingly possible to remove the fastener elements without damaging the cores, and so high precision is not required in positioning the fastener elements of a space-forming section in a cutting station, thus making the structure of the apparatus simple to improve the rate of production. Especially when the legs of the fastener elements are cut at the ends of the legs toward the coupling heads, no burr due to the cutting bites into the cores. Accordingly, any resistance to pulling the heads off of the cores due to burrs bitting into the cores is reduced. Therefore the fastener elements can be removed in a simple action without damaging the cores, thus a high quality product is guaranteed.

DETAILED DESCRIPTION OF THE PREFERRED EMBODIMENTS

Figure 1:
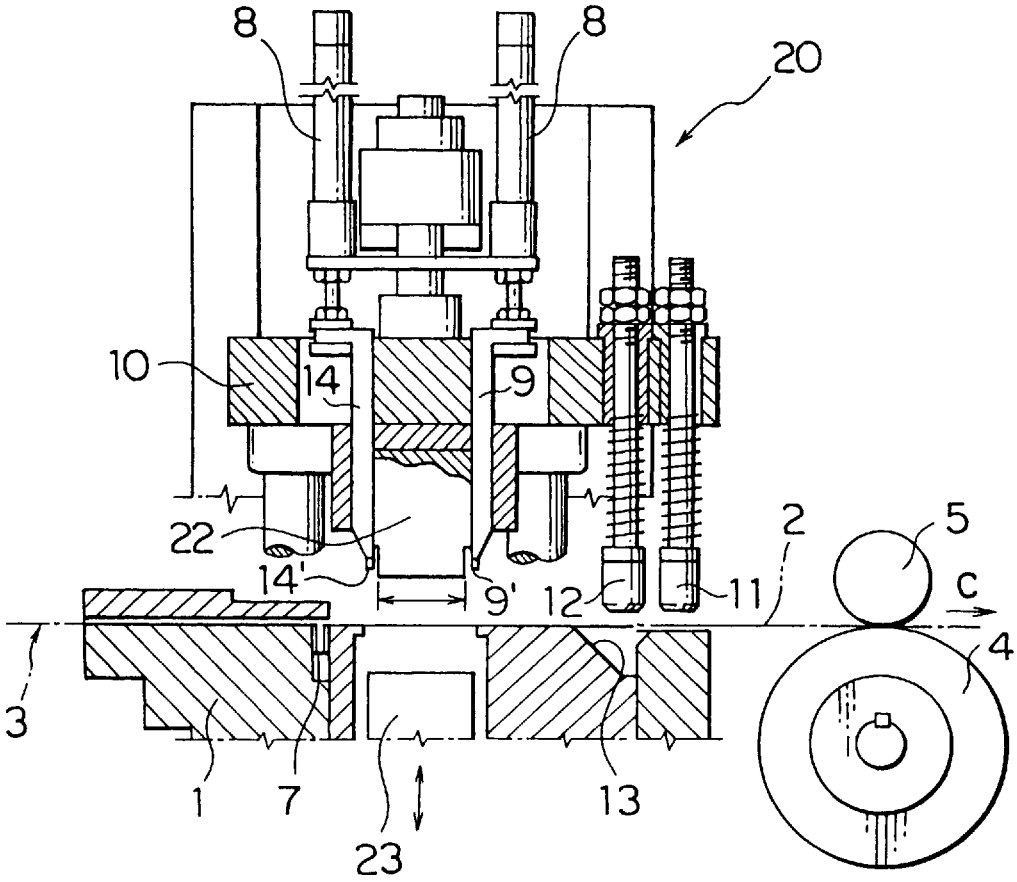
FIG. 1 is a front view, partially in cross section, of an apparatus, for forming an element-free space portion in a slide fastener chain, according to a typical embodiment of this invention.

Preferred embodiments of this invention will now be described in detail with reference to the accompanying drawings. FIG. 1 shows a space forming process of this invention. This space forming process is substantially identical with that disclosed in Japanese Patent Publication No. Hei 6-49008 except an element removing apparatus. Therefore only the operation steps thereof is described.

A continuous slide fastener chain 2 having a pair of coupled metallic fastener element rows is intermittently fed in a direction of an arrow C along a traveling path 3 on a base 1 by a drive roller 4 and a follower roller 5. When a space-forming section of the slide fastener chain 2 arrives at a position under an element removing apparatus 20, a detector 7 outputs a detection signal to interrupt the rotation of the rollers 4, 5, thus stopping the feed of the slide fastener chain 2. The slide fastener chain 2 includes a pair of fastener tapes 2*a* and metallic fasteners E, which have a coupling head Eh and upper and lower legs El (FIGS. 2 and 3).

Figure 2:
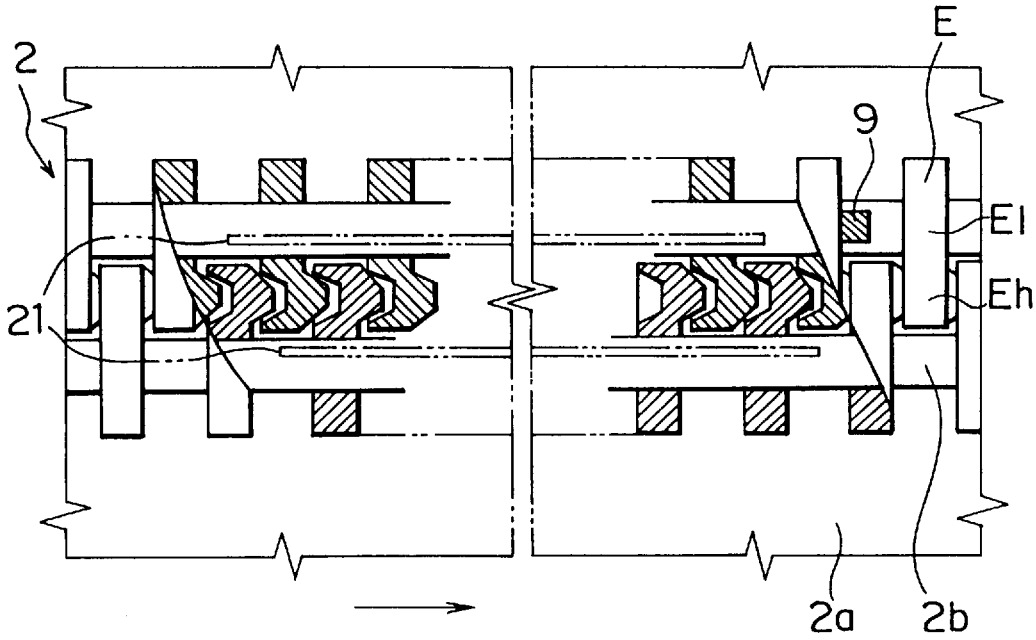
FIG. 2 is a fragmentary plan view, with parts broken away, of a space-forming section of the slide fastener chain to be processed on the apparatus of FIG. 1.
Figure 3:
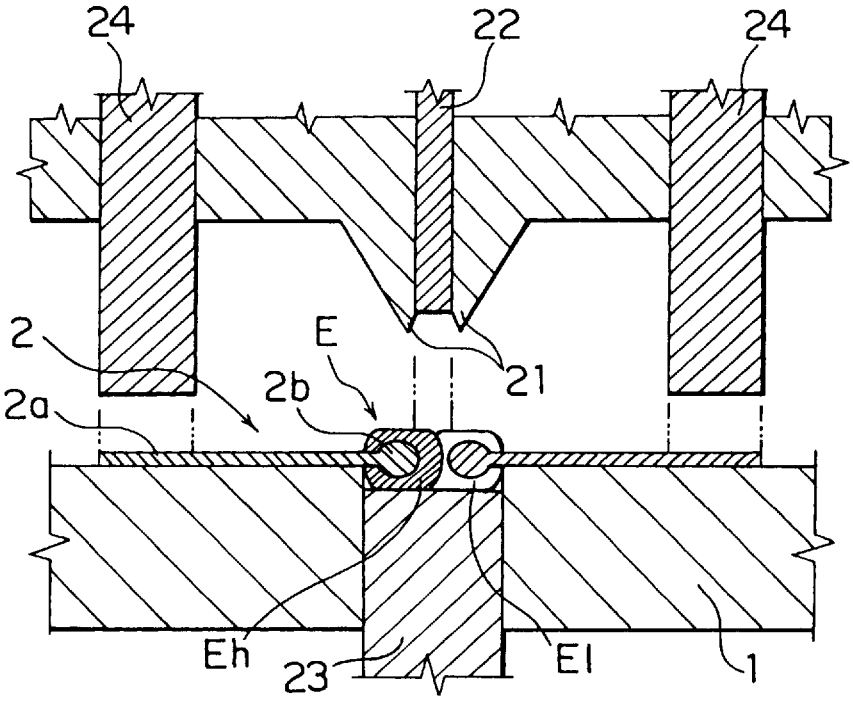
FIG. 3 schematically shows an initial stage of cutting of fastener elements according to the first embodiment.

Then, as shown in FIGS. 1 and 2, an air pressure cylinder 8 is actuated to move a first positioning pin 9 on the downstream side downwardly so that the first positioning pin 9 comes into engagement with a leg of a fastener element at an end of a non-space-forming section contiguous to the fastener elements at the downstream end of the space-forming section. At that time, a tip 9' of the first positioning pin 9 is in contact with the surface of the leg of the fastener element. Alternatively, the tip 9' may be inserted between the leg of the fastener element at the end of the non-space-forming section and the leg of the downstream-end fastener element of the space-forming section contiguous to the non-space section, depending on the position at which the space-forming section of the slide fastener chain 2 is stopped.

Subsequently, a movable block 10 is lowered to hold the slide fastener chain 2 by a first pad 11 and then to push the slide fastener chain 2 slightly into a groove 13 of the base 1 by a second pad 12. By the action of the first and second pads 11, 12, the slide fastener chain 2 positioned under the element removing apparatus 20 is slightly tensioned in the downstream direction so that the tip 9' surely engages the leg of the fastener element. Therefore the downstream end of the space-forming section can be positioned exactly in the element removing station. Then a punch 22 and a die 23 (FIG. 3) move toward each other to clamp a predetermined length of the metallic fastener element rows at their coupling heads from the upper and lower sides, where-upon a double cutting blade 21 is lowered to cut upper legs El each at a position toward the individual coupling head of the fastener element rows along a more than half length of the space-forming section and to scatter the cut upper legs El off the slide fastener chain 2. Then the cutter blade 21, the first positioning pin 9, the first pad 11 and the second pad 12 return to their original inoperative positions, thus completing the process of forming the downstream half of an element-free space portion in the continuous slide fastener chain 2. In this embodiment, each cutter blade 21 has a wedge-shape cross section with its thickness increasing upwardly so that the upper legs El are scattered when they are cut by the cutting blade 21.

Then the slide fastener chain 2 is fed again in the direction of the arrow C. When the remaining part of the fastener elements of the space-forming section arrives at the position under the cutting blade 21, the detector 7 issues another detection signal to interrupt the rotation of the rollers 4, 5, thus stopping the feed of the slide fastener chain 2. When the feeding is stopped, a second positioning pin 14 on the upstream side is lowered to contact with the leg of the fastener element at the end of a non-space-forming section contiguous to the fastener element at the upstream end of the space-forming section. The rest of the contacting operation of the second positioning pin 14 with the fastener element is similar to that of the first positioning pin 9 at the downstream.

At that time the first and second pads 11, 12 resiliently act on the slide fastener chain 2 so that the remaining part of the fastener elements on the upstream side which corresponds to a half of the whole length of the space-forming section is positioned exactly in the element removing station though the slide fastener chain 2 is locally expanded or shrunk. Then the cutter blade 21 is lowered to cut the coupling heads of the remaining part of the fastener elements to remove them from the slide fastener chain 2, whereupon the cutter blade 21, the second positioning pin 14, and the first and second pads 11, 12 return to their original inoperative positions. Thus, by two space-forming operations at downstream and upstream sides, a single cycle of space forming process is completed. Then the slide fastener chain 2 is fed again to start the next cycle. As a result, a plurality of element-free space portions are formed successively at predetermined distances in and along the slide fastener chain 2.

A fastener element removing apparatus 20 of this invention comprises the base 1 with a long and narrow central gap for guiding the pair of fastener tapes 2*a* of the fastener chain 2 longitudinally, the punch 22 and the die 23 situated in a confronting relationship over and under the central gap of the base 1 for vertical movement to clamp the coupling heads Eh of the fastener elements E in the space-forming section L of the slide fastener chain 2 and to move beyond the space-forming section L downwardly or upwardly, and the pair of cutter blades 21 operable in timed relation with the punch 22 for cutting one of the upper and lower legs El of each of the fastener elements E, which are clamped by the punch 22 and the die 23, at a position toward the individual coupling head Eh.

The two cutting blades 21 are situated in frictional contact with opposite side surfaces of the punch 22 and is actuated by, for example, a non-illustrated fluid pressure cylinder independently of the punch 22 for cutting only one of the upper and lower legs El of each of the fastener elements E existing in the space forming station. The apparatus 20 has, in addition to the foregoing members, a pair of pressure members 24 arranged in symmetry with respect to the cutter blades 21 and spaced apart by a predetermined distance from each other. After the first and second pads 11, 12 act on the slide fastener chain 2, the pressure members 24 are lowered by a drive mechanism, such as a non-illustrated fluid pressure cylinder or a cam mechanism, likewise the cutting blades 21, the punch 22 and the die 23 to press the opposed fastener tapes 2*a* of the slide fastener chain 2 against the upper surfaces of the base 1, thus securing the slide fastener chain 2 in position. The die 23 is situated in confronting relationship with the punch 22 with the base 1 therebetween and coacts with the punch 22 to clamp the coupling heads Eh of the fastener elements E and to remove the cut coupling heads Eh and the leftover legs El extending from the coupling heads Eh off the slide fastener chain 2, thus forming an element-free space portion SP.

FIG. 2 is a fragmentary plan view showing the relationship between the cutting blades and the fastener elements when an element-free space portion is formed. The two cutting blades 21 are staggered by one pitch of the fastener element longitudinally of the slide fastener chain 2 and have a length larger than a half length of the space-forming section and smaller than the length of the space-forming section. The positioning of a space-forming section of the slide fastener chain 2 is performed by the first and second positioning pins 9, 14 in substantially the same manner as in the method disclosed in Japanese Patent Publication No. Hei 6-49008. The punch 22 has a length equal to that of the cutting blades 21.

Figure 4:
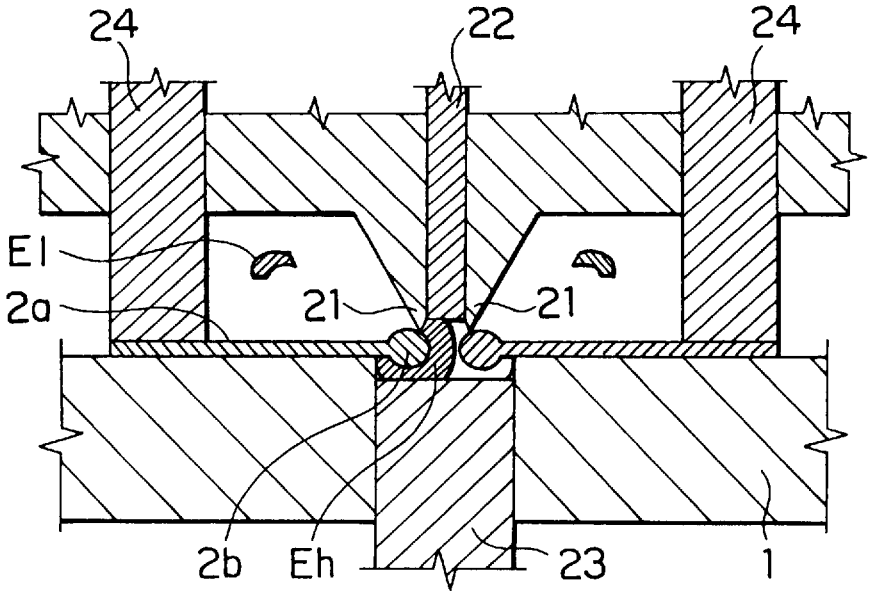
FIG. 4 schematically shows the manner in which part of legs of the fastener elements are cut according to the first embodiment.
Figure 5:
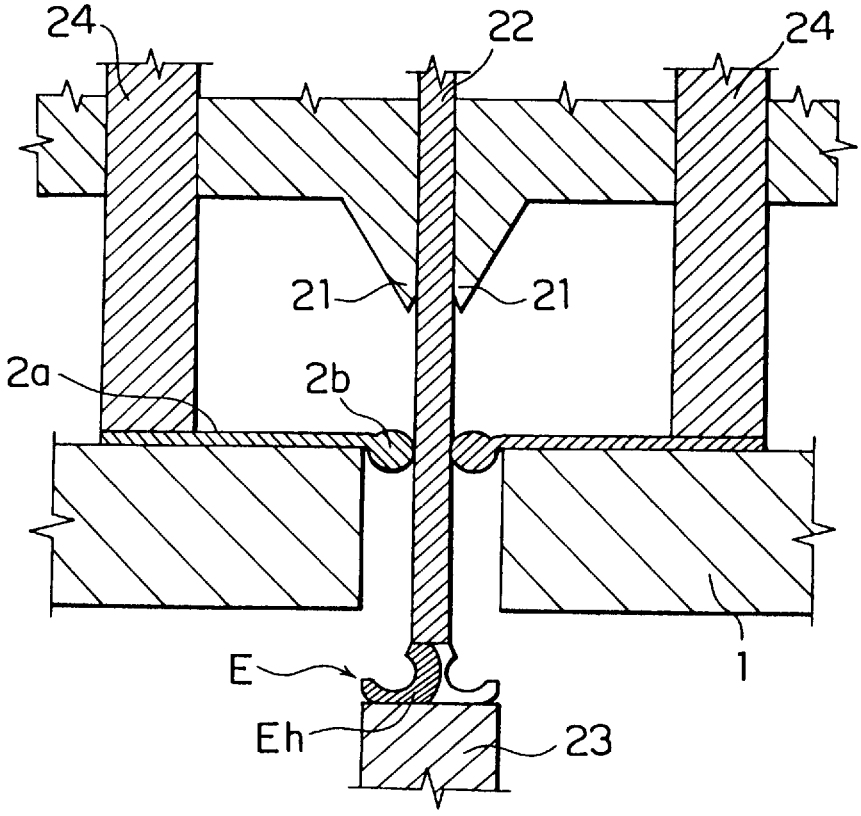
FIG. 5 schematically shows the manner in which remaining coupling heads and other parts of the legs are removed.

The apparatus 20 of this invention is simple and compact in structure as described above and is therefore simple in operation. FIGS. 3 through 5 show a space forming process using the apparatus 20. FIG. 3 shows the initial stage of a cutting process by the cutting blades 21. A continuous slide fastener chain 2 is fed, by non-illustrated feeding means, to a predetermined position on the base 1 on which the apparatus 20 is mounted as an element-free space forming apparatus. When the space-forming section of the coupled fastener element rows attached for the continuous slide fastener chain 2 arrives at the apparatus 20, the feed of the slide fastener chain 2 is interrupted, at which time the fastener element rows of the slide fastener chain 2 is supported on the upper surface of the vertically movable die 23 along the central gap in the base 1 as shown in FIG. 3. At the same time, the free ends of the legs El on the lower side of the slide fastener chain 2 are sandwiched between the confronting inner surfaces of the base 1 so that the fastener elements E are laterally positioned as shown in FIG. 3. In the meantime, the vertically movable punch 22 situated above the fastener element rows, the vertically movable cutting blades 21 situated in frictional contact with opposite side surfaces of the punch 22 and the two pressure members 24 situated on right and left sides of the cutting blades 21 are still in their standby positions.

Then the punch 22 and the pressure members 24 are lowered as indicated by phantom lines in FIG. 3. The punch 22 thereby comes into contact with the coupling heads Eh of the fastener elements E to clamp the fastener element rows from the upper and lower sides between the punch 22 and the die 23, while the pressure members 24 resiliently presses the fastener tapes 2*a* against the upper surface of the base 1 to sandwich the fastener tapes 2*a* between the pressure members 24 and the base 1.

Then the two cutting blades 21 situated on opposite sides of the punch 22 are lowered simultaneously toward the fastener elements E to cut the fastener elements on the upper surface of the slide fastener chain 2. The individual leg El is cut at a position off the center of the core toward the coupling head Eh as shown in FIG. 4. The upper-side legs El cut off the coupling heads Eh and scattered are sucked by a non-illustrated blower for discharge out of the space forming apparatus.

In the meantime, the coupling heads Eh and the legs El left over on the lower side of the fastener tapes 2*a* after the cut legs El have been removed from the slide fastener chain 2 are clamped between the punch 22 and the die 23, whereupon the clamped element portions Eh, El are removed off the cores 2*b* as the punch 22 and the die 23 are simultaneously lowered through the opposed fastener tapes 2*a*, as shown in FIG. 5. At the time the cutting blades 21 are raised to return to their original positions. Then the punch 22 is raised to release the clamping of the leftover element portions Eh, El, and at the same time, the released element portions Eh, El are blown or sucked off the upper surface of the die 23 by an air blower for discharge out of the space forming apparatus. Then the die 23 and the pressure members 24 are raised to return to their original positions, thus assuming their standby positions of FIG. 3.

Figure 6:
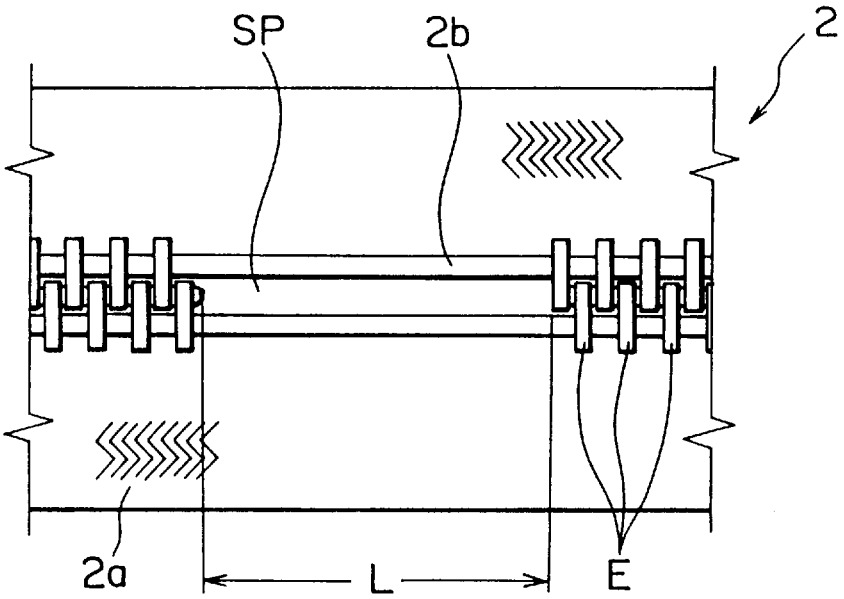
FIG. 6 is a fragmentary plan view of a slide fastener chain, showing an element-free space portion.

In this embodiment, the coupling elements existing in the downstream part of the space-forming section of the slide fastener chain 2 are cut and removed as the downstream end of the space-forming section is positioned by the first positioning pin 9, and the slide fastener chain 2 is fed, and then the upstream end of the space-forming section is positioned by the second positioning pin 14, whereupon the coupling elements existing on the upstream part of the space-forming section are cut and removed. As a result, a predetermined length of element-free space portion SP is formed as shown in FIG. 6.

Then, the continuous slide fastener chain 2 is fed by a predetermined length by non-illustrated conveying means until the next space-forming section arrives at the apparatus 20, whereupon the foregoing process is performed once again to form the next element-free space portion SP. Thus a plurality of element-free space portions are formed successively at predetermined distances in and along the continuous slide fastener chain 2 as the cycle of space forming process is repeatedly performed.

Figure 7:
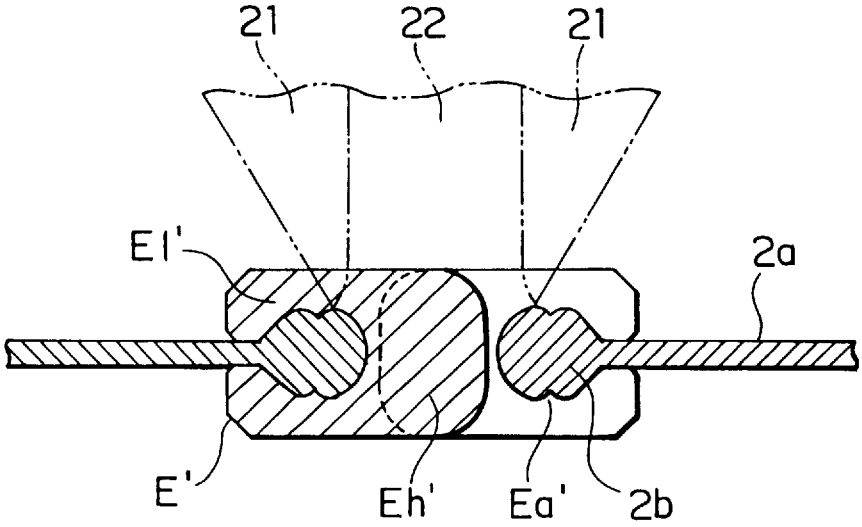
FIG. 7 shows the manner in which part of legs of modified fastener elements are cut according to a second embodiment.

FIG. 7 shows a second embodiment showing an element removing apparatus 20' of the invention suitable for modified fastener elements E'. The individual leg El' of FIG. 7 has a projection Ea' which bites into the core 2*b* of the continuous slide fastener chain 2. Especially in a slide fastener using small-size metallic fastener elements, since the area in which the cores 2*b* and the individual fastener element El contact each other is small, the projection Ea' is provided to secure the fastener element E' in position. The cutting blades 21 cut the individual leg El' at a position off the center of the core toward the coupling head, avoiding the projection Ea' as indicated in phantom lines in FIG. 7.

The sequential procedure and timing of each of the above-mentioned members or parts are controlled by a command from a non-illustrated control unit, such as a micro-processor, based on measurement and detection signals issued from known measuring and detecting means, such as non-illustrated encoders, micro switches and photo sensors.

As is apparent from the foregoing description, according to the method and apparatus of this invention, since the element-free space portion SP is formed by cutting the legs El exposed on one side of the slide fastener chain 2 and scattering the cut legs El and then by removing the coupling heads Eh and the legs El left over on the other side of the slide fastener chain 2 from the cores 2*b* with these leftover fastener element portions clamped between the punch 22 and the die 23, it is possible to remove the fastener elements E from the space-forming section without damaging the cores 2*b* and without requiring high precision in positioning the space-forming section of the slide fastener chain 2 at the element removing station, thus the apparatus structure can be simple and the rate of production is improved.

Further, partly since metallic fastener elements E are removed by cutting one of upper and lower legs El of the individual fastener element E rather than by punching out coupling heads Eh, and partly since the cutting blade 21 extends to the center of a gap, which equals to one pitch of the fastener element, between a space-forming section and a non-space-forming section contiguous to the space-forming section, it is possible to remove the fastener elements E from the space-forming section, without damaging the fastener elements E of a non-space-forming section by the cutting blade 21. And even when the fastener-element pitch varies due to expansion and shrinkage of the slide fastener chain, the fastener elements can be removed accurately so that good quality slide fasteners can be produced with increased efficiency.

When the individual leg El is cut at a position off the center of the core 2*b* toward the coupling head Eh, any burr due to the cutting of the legs El does not bite radially into the core 2*b* so that the resistance due to the burrs when pulling the coupling heads Eh off the cores 2*b* is reduced. It is accordingly possible to remove the leftover fastener element portions away from the space-forming section without damaging the cores 2*b*, guaranteeing excellent quality products.

What is claimed is:

1. A method of forming an element-free space portion in a continuous slide fastener chain having a pair of coupled rows of metallic fastener elements mounted on and along confronting inner edges of a pair of fastener tapes, said method comprising the steps of:

(a) clamping a number of fastener elements, which exist in a space-forming section of the fastener element rows, at their coupling heads by a punch and a die;

(b) cutting one of upper and lower legs of each of the clamped fastener elements at a position toward the coupling head and between a center of a core of said fastener tape and said punch by a wedge-shaped cutting blade having a tip spaced laterally away from said punch and, at the same time, scattering the cut legs; and (c) with the coupling heads and the other legs, which are left over on the fastener tapes, clamped by the punch and the die, removing the leftover fastener element portions from the fastener tapes by pushing the leftover fastener element portions outwardly in a direction perpendicular to the plane of the fastener tapes.

2. A method according to claim 1, wherein said cutting of the legs is performed at a boundary portion between the coupling heads and cores of the fastener chain.

3. An apparatus for forming an element-free space portion in a continuous slide fastener chain having a pair of coupled rows of metallic discrete fastener elements mounted on and along confronting inner edges of fastener tapes, said apparatus comprising:

(a) a base having a long and narrow central gap for guiding the continuous slide fastener chain in a longitudinal path;

(b) a punch and a die situated above and under said central gap of said base for vertical movement to clamp a number of fastener elements, which exist in a space-forming section in the continuous fastener chain, at their coupling heads and to push the clamped fastener elements out of the space-forming section upwardly or downwardly; and (c) a pair of horizontally spaced cutting blades cooperative with said punch for cutting and scattering upper or lower legs of the fastener elements in a single cutting blade motion, said fastener elements clamped by said punch and said die at positions adjacent to their coupling heads, wherein each one of said cutting blades has a wedge-shape in cross section and a blade tip spaced laterally away from said punch and positioned between a center of a core of said fastener tape and said punch.

4. An apparatus according to claim 3, wherein said pair of cutting blades have the same length and are staggered by a pitch of the fastener element in a direction of travel of the fastener chain.

* * * * *